US005899841A

United States Patent [19]

Berger

[11] Patent Number: 5,899,841

[45] Date of Patent: May 4, 1999

[54] DEVICE FOR MECHANICALLY BINDING DOCUMENTS

[75] Inventor: Christian Berger, Saint-Légier-La Chiésaz, Switzerland

[73] Assignee: Metodya B & B, Saint-Légier-La Chiésaz, Switzerland

[21] Appl. No.: 08/732,219

[22] PCT Filed: Apr. 24, 1995

[86] PCT No.: PCT/CH95/00087

§ 371 Date: Mar. 10, 1997

§ 102(e) Date: Mar. 10, 1997

[87] PCT Pub. No.: WO95/29056

PCT Pub. Date: Nov. 2, 1995

[30] Foreign Application Priority Data

| | | | |
|---|---|---|---|
| Apr. 19, 1994 | [CH] | Switzerland | 1294/94 |
| Feb. 6, 1995 | [CH] | Switzerland | 320/95 |

[51] Int. Cl.[6] ..... B31F 5/02; B42F 3/00

[52] U.S. Cl. ..... 493/351; 493/353; 493/392

[58] Field of Search ..... 493/392, 390, 493/379, 393, 374, 394, 353, 356, 350, 351

[56] References Cited

U.S. PATENT DOCUMENTS

| | | | |
|---|---|---|---|
| 1,055,680 | 3/1913 | Stacy et al. | 493/392 X |
| 1,130,589 | 3/1915 | Gage | 493/392 X |
| 1,229,213 | 6/1917 | Bernard | 493/392 X |
| 1,324,103 | 12/1919 | Cone | 493/392 X |
| 3,577,575 | 5/1971 | Taniguchi | 7/14.1 |
| 5,024,643 | 6/1991 | Kastner | 493/351 |

FOREIGN PATENT DOCUMENTS

| | | |
|---|---|---|
| 0099162 | 1/1984 | European Pat. Off. . |
| 56136 | 9/1952 | France . |
| 1335083 | 8/1963 | France . |
| 674727 | 7/1990 | Switzerland . |
| 16781 | of 1912 | United Kingdom . |
| 26027 | of 1914 | United Kingdom . |
| 179692 | 5/1922 | United Kingdom . |
| 508663 | 7/1939 | United Kingdom . |
| 2252525 | 8/1992 | United Kingdom . |
| 9212862 | 8/1992 | WIPO . |

*Primary Examiner*—James F. Coan
*Attorney, Agent, or Firm*—Pauley Peterson Kinne & Fejer

[57] ABSTRACT

A device for the mechanical connection of documents comprising a base, a paper support, a cover pivotably connected to said base, a stylus with an eye for creating a cut, a stamping and bending element for stamping out and pushing a plurality of paper tongues though said eye, said stamping and bending element having a cutting face in the form of a stamping plunger and a projection for bending the stamped out paper tongues, and a carrier for actuating the pivot movement. The stamping and bending element is pivotably fastened on the base. The paper support forms a pushing element which can be lowered into the base and which is maintained in an upper position of rest by a spring. The paper support, as a die plate for stamping the paper tongues, forms a first recess, and, for stamping the cut, forms a second recess.

5 Claims, 3 Drawing Sheets

DEVICE FOR MECHANICALLY BINDING DOCUMENTS

The invention relates to a device for the mechanical connection of documents in accordance with the preamble of claim 1.

Today, documents of a size of a few pages or sheets of paper are customarily stapled. Simple staplers of various sizes are used for this. They consist of a base, a staple magazine pivotably connected with it and a cover, pivotably connected with both and having a plunger. The papers are bundled and held between the staple magazine and the base, then the cover is pushed down, in the course of which the plunger pushes one staple out of the staple magazine downward through the papers on the base. The staple is bent on a slot in the base. However, the use of metal staples is often not desired or even prohibited. For example, they are an obstacle to recycling of paper. For this reason several attempts have been made to create a staple-free fastening.

Such a fastening device operating without staples is known from U.S. 3,577,575 (Fumio Taniguchi). The design corresponds to that of a stapler. Instead of pushing staples through the paper, a paper tongue is stamped out in three directions with a stamping knife. Simultaneously a cut is made in the paper transversely thereto by a stylus. The stylus has an eye, a pivot cam is provided in the stamping knife. It is pivoted after the tongue has been stamped. In the course of this it bends the cut-out paper tongue back and guides it into the recess on the stylus. When the fastening device is released, the pivot blade and the stylus are retracted from the paper. In the process the paper tongue is pulled through the slit to the other side of the paper. In this way the layers of paper are kept together by the paper tongues which have been cut out and pulled through. This device has the advantage that no metallic or other staples are needed. Fastening takes place by means of the paper itself. However, with the fastener open, the blades are free-standing. They are easily damaged and constitute a considerable danger of injury for the user. These fastening devices are put together from more than thirty individual elements.

It is the object of the invention to provide a fastening device wherein the stamping and cutting elements are not uncovered either in the state of rest or during, instead they are completely protected. It is intended that they do not become damaged and should not present any danger of injury to the user.

This object is attained by the invention recited in the claims.

A further advantage of the invention resides in that a fastening device in accordance with the invention can be constructed of only seven individual parts. This considerably reduces the production costs and reduces the susceptibility to trouble.

Figure 1:
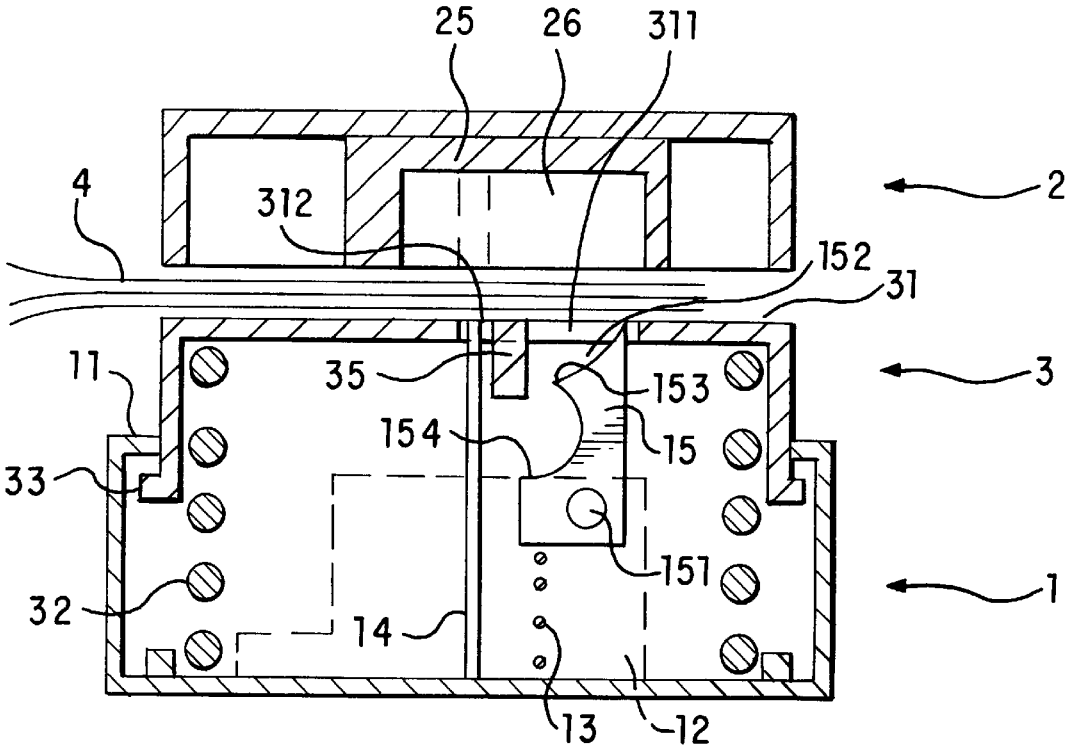
Figure 2:
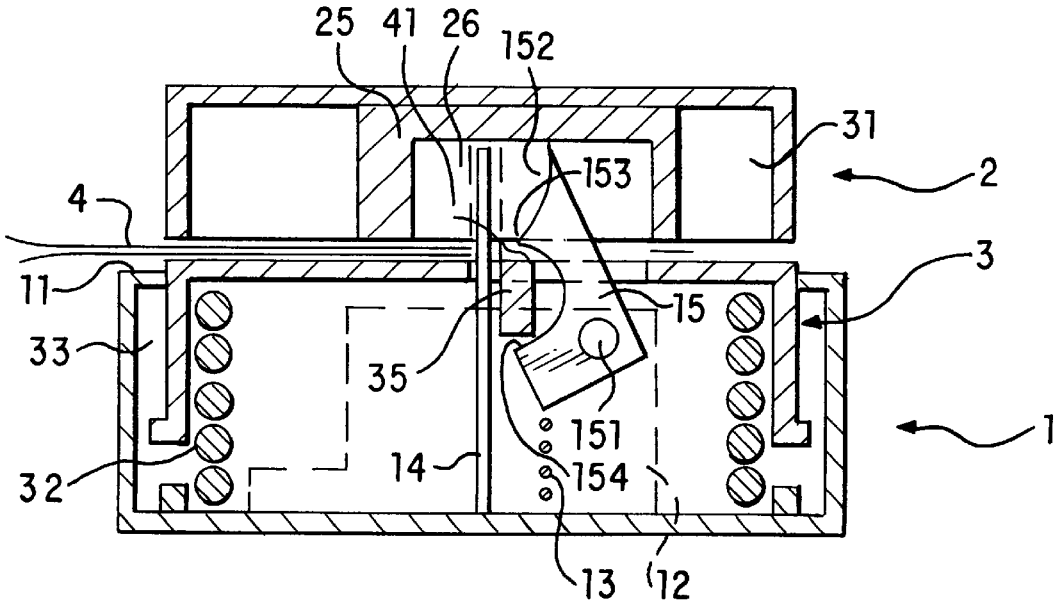
Figure 3:
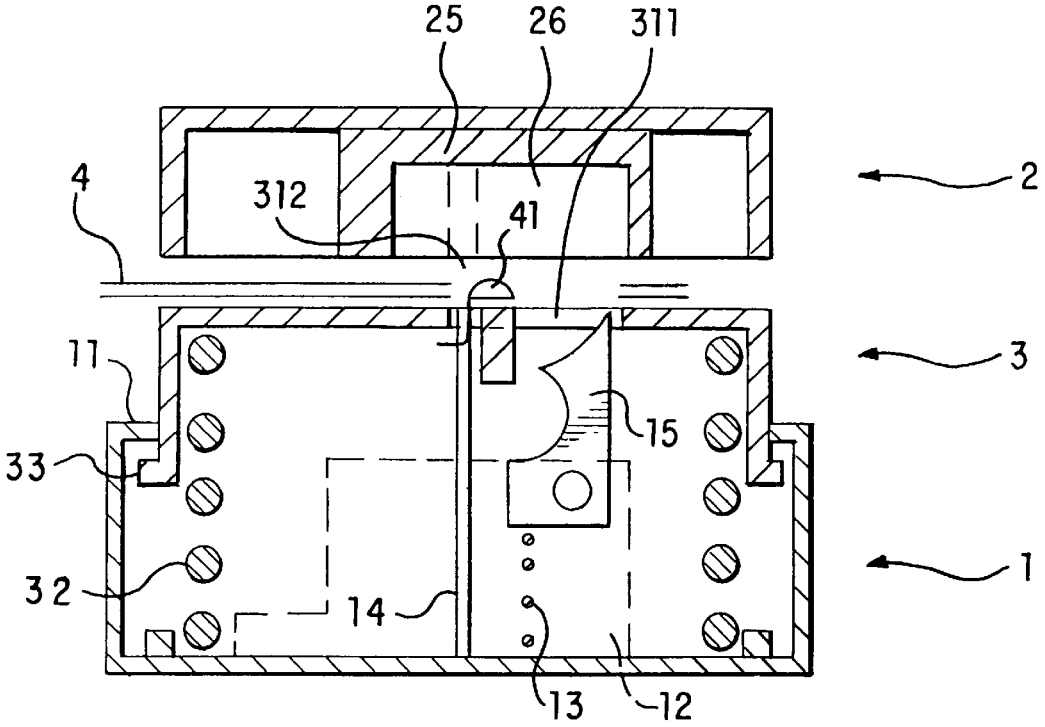

The invention will be described below in connection with the drawings. Shown are in:

FIG. 1, a device in accordance with the invention in cross section, with paper webs inserted, in the position of rest;

FIG. 2, a device in accordance with the invention in cross section, with paper webs inserted, at the end of the fastening process;

FIG. 3, a device in accordance with the invention in cross section, with fastened paper webs at the conclusion of the fastening process in the position of rest.

Figure 4:
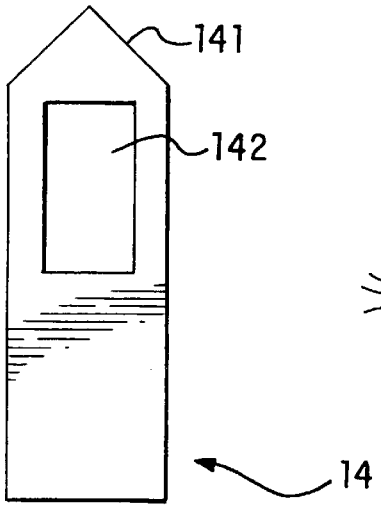
Figure 5:
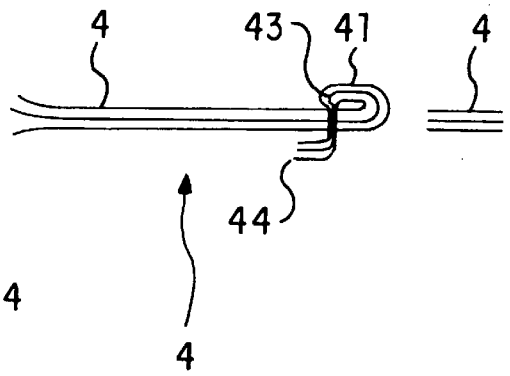
Figure 6:
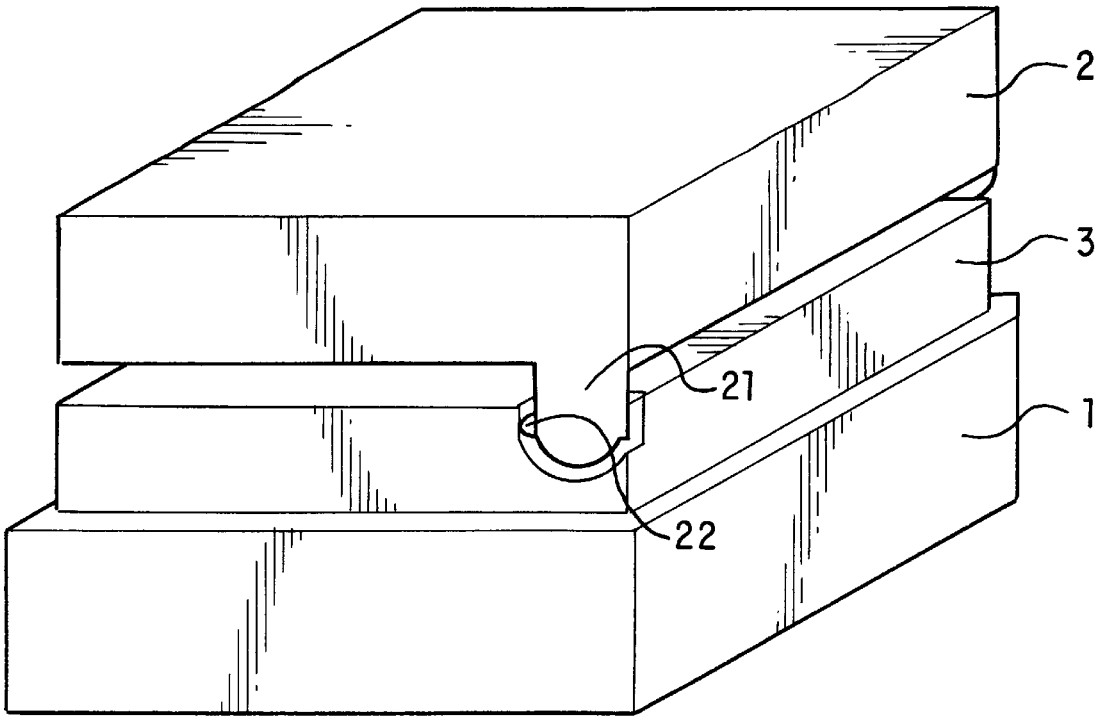

FIG. 4, the stylus in a front view;

FIG. 5, fastened sheets of paper in cross section;

FIG. 6, a plan view of the device, and

Figure 7:
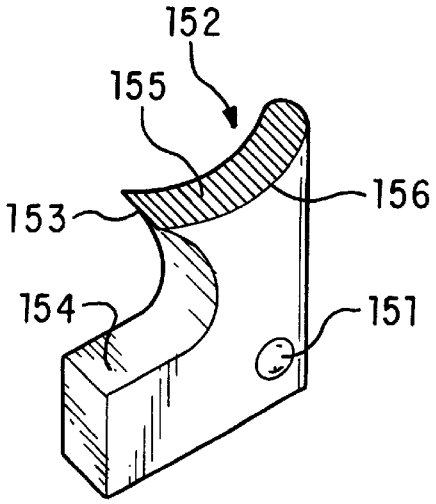

FIG. 7, a plan view of the pivoting and bending element.

A device in accordance with the invention is shown in FIG. 1 in the position of rest with paper webs inserted. It consists of three main elements, namely the base 1, a pushing element 3 and a cover 2.

The base 1 is U-shaped in cross section, it has inward projecting first detent cams 11 on the lateral flanks. A bearing block 12 is disposed on the bottom of the base 1. A stamping and bending element 15 is pivotably fastened on it, and an upward projecting stylus having cutters and an eye is also fastened thereon. The stamping and bending element 15 is pivotably maintained on the bearing block 12 in a pivot fastening 151. It has a carrier 154 for the operative connection with a cam 35 and a surface designed as a stamping plunger 152. The stamping and bending element 15 is pressed into its position of rest by a restoring spring 13.

In cross section the pushing element 3 also has a U-shape, open toward the bottom. The pushing element 3 is of such a size, that is held so it can be pushed into the base 1 in an exactly guided manner. It has second laterally outward projecting retaining cams 33, which in the state of rest contact the first retaining cams 11 and in this way delimit the position of the pushing element 3. A spring 32 presses the pushing element 3 into this position of rest. Additional guides for the exact displaceability of the pushing element 3 may be provided. On the outside of the top the pushing element 3 is designed flat as a paper support 31. It has a first recess 311 on the inside, whose surface corresponds to the paper tongue which is to be stamped out on three sides, and as a die plate corresponds to the stamping plunger 152 of the stamping and bending element 15. A second recess 312 is located at a distance therefrom and is provided as a die plate for the stylus 14. The flat piece of the paper support 31 between these recesses 311 and 312 is downwardly widened as a cam 35. The cam 35 is used as an operative connection for pivoting the stamping and bending element 15.

The cover 2 also is a U-shaped profile in cross section and open toward the bottom. A die plate 25 with a blind bore 26 is located in its interior. This die plate 25 or respectively the blind bore 26 corresponds in its base surface to the areas of the first and second recesses 311, 312 in the pushing element 3 and therefore to the space required by the tip of the stylus and the stamping and bending element when the cover 2 and the pushing element 3 with it are pushed down into the base 1. The cover 2 is pivotable on its edge and connected pivotably in the manner of a hinge with the pushing element 3.

The sequence of the process of fastening can be seen from FIGS. 1 to 3. First, the cover 1 is pivoted backward, after which several paper webs 4 are placed on the paper support 31. In accordance with FIG. 1, the stylus 14 and the bending and stamping element 15 are completely located between the pushing element 3 and the bottom of the base, covered and protected on the inside. After this, the cover 2 is pivoted back again. The paper webs 4 are covered.

Pressure is now exerted on the cover 2 and the pushing element 3 is pushed downward against the force of the spring 32 into the base 1. In the process, the stylus 14 and the stamping and bending element 15 push upward through the paper webs. In the course of this the stylus 14 creates a cut through the paper webs and the stamping and bending element 15 cuts a tongue 41 on three sides into the paper webs. The tongue 41 remains attached to the paper webs on the side oriented against the cut of the stylus 14. As soon as the pushing element 3 has been pushed into the base 1 by a defined distance, the cam 35 comes into contact with the carrier 154 of the stamping and bending element 15 and pushes it downward. By means of this the stamping and bending element 15 is pivoted in the direction toward the stylus around the pivot bearing 151. It bends the paper tongues 41 backward with its projection 153 and in accordance with FIG. 2 pushes their free ends through the eye 142 which has now come clear.

The cover 2 is now released again. The spring 32 presses the pushing element 3 back into its position of rest. In the course of this the paper tongues 41 are pulled by the eye 142 in the stylus through the cut in the paper webs 4 to the underside of the paper webs, as can be seen in FIG. 3. There is now a small opening in the paper in the area of the cut-out tongues 41. The tongues 41 form a loop on the top of the paper web, are led through the slit to the underside and approximately rest on the underside of the paper webs. The lid 2 can be pivoted back and the fastened paper webs 4 can be removed from the device. The fastener can be used again.

The stylus 14 is represented in FIG. 4 in a front view. It resembles a sewing needle. The cutters 141 for creating the slit in the paper webs and the eye 142 slightly below them can be clearly seen.

The appearance of paper webs in the fastened state is represented in FIG. 5. The tongues 41 of the paper web are bent over or even folded over 42, are pulled approximately perpendicularly 43 through the cut and rest with their free ends 44 approximately against the underside of the paper webs.

An overview of the device is represented in FIG. 6. The base surface of the pushing element 3 is minimally less than the base 1. The base surface of the cover 2 approximately corresponds to the pushing element 3. By means of the pivot joints 21 it is pivotably connected with the pushing element in the area of one edge. By pressing on the cover 2, the pushing element 3 can be pushed telescopically into the base 1. In the course of this, this insertion operates the fastening process, as described above.

The stamping and bending element 15 is shown in greater detail in a view in FIG. 7. The stamping plunger 152 has a cutting face 155, which corresponds to the shape of the paper tongues to be cut out. For cutting or respectively stamping, this cutting face 155 is formed by the cutter edges 156 on three sides. These cutter edges 156 can be hardened or formed so they slightly project upward. In a preferred embodiment, the design of the cutting face 155 can also be slightly arched upward as represented in FIG. 7. It then presents the appearance of a piece from a cylinder surface. This embodiment cuts the paper tongues very precisely and in the process simultaneously initiates the bending process. On its non-cutting end, the cutting face 155 makes a transition into the projection 153. The projection 153 terminates the back-bending of the stamped paper tongues and folds them by pressing the paper tongue against the paper web surface and the paper support. The carrier 154 is designed as a shoulder of the entire part. In the course of inserting the pushing element 3, the cam 35 of the paper support 3 presses on this carrier 154 and causes the pivoting of the stamping plunger 15 and therefore the cutting and bending process. The pivot bearing 151 is located at a suitable position at a distance from the carrier 154, the projection 153 and the stamping plunger 152.

It can be clearly seen, in particular from FIG. 6, that in the novel fastening device the stamping and cutting elements are completely protected in the position of rest as well during use. They cannot be damaged. Therefore the user cannot injure himself. The cover is provided with a small baffle 22 in the area of the pivot joint, which minimally lifts the cover by contacting the pushing element 3 laterally for the easier removal of fastened papers from the device. This makes it possible to pull out fastened papers without having to open the cover 2.

I claim:

1. In a device for the mechanical connection of documents, comprising a base (1), a paper support (31), a cover (2) pivotably connected to said base (1), a stylus (14) with an eye (142) for creating a cut, means for stamping out and pushing a plurality of paper tongues (41) through the eye (142), a pivotable stamping and bending element (15) having a cutting face (155) in a form of a stamping plunger (152), a projection (153), said projection (153) bending said plurality of paper tongues and a carrier (154), said carrier (154) actuating a pivot movement, the improvement comprising: the pivotable stamping and bending element (15) pivotably fastened on the base (1) and said paper support (31) forming a pushing element (3) which can be lowered into the base (1), which is maintained in an upper position of rest by a spring (32) and, as a die plate for stamping said plurality of paper tongues, forms a first recess (311), and for stamping the cut forms a second recess (312).

2. A device in accordance with claim 1, wherein the cover (2) comprises a die plate having a blind bore (26), said blind bore (26) receiving the stamping and bending element (15) and the stylus (14).

3. A device in accordance with claim 1, wherein the cover (2) is pivotably connected to the pushing element (3).

4. A device in accordance with claim 1, wherein the carrier (154) is operatively connected to a cam disposed on the pushing element (3).

5. A device in accordance with claim 1, wherein the cutting face (155) of the stamping and bending element (15) is arched.

* * * * *